United States Patent [19]

Freier et al.

[11] 4,397,697

[45] Aug. 9, 1983

[54] HOT STRIPS OR HEAVY PLATES FROM A DENITRATED STEEL AND METHOD FOR THEIR MANUFACTURE

[75] Inventors: Klaus Freier, Wolfenbüttel; Constantin M. Vlad, Nordassel; Klaus Hulka, Hohenassel, all of Fed. Rep. of Germany

[73] Assignee: Stahlwerke Peine-Salzgitter AG, Peine, Fed. Rep. of Germany

[21] Appl. No.: 212,675

[22] Filed: Dec. 3, 1980

[30] Foreign Application Priority Data

Dec. 6, 1979 [DE] Fed. Rep. of Germany ..... 2949124
Aug. 8, 1980 [DE] Fed. Rep. of Germany ..... 3030060

[51] Int. Cl.[3] ..... C21D 8/02

[52] U.S. Cl. ..... 148/12 F; 148/12.4; 148/36

[58] Field of Search ..... 148/12 F, 12.4, 36

[56] References Cited

U.S. PATENT DOCUMENTS 3,704,180 11/1972 Heitmann et al. ..... 148/12 F
3,849,209 11/1974 Ishizaki et al. ..... 148/12 F
3,918,999 11/1975 Sekine et al. ..... 148/12 F
3,976,514 8/1976 Matsukura et al. ..... 148/12 F
4,137,104 1/1979 Nashiwa et al. ..... 148/36
4,184,898 1/1980 Ouchi et al. ..... 148/12 F
4,219,371 8/1980 Nakasugi et al. ..... 148/12 F

FOREIGN PATENT DOCUMENTS 52-20322 2/1977 Japan ..... 148/12.4

*Primary Examiner*—Peter K. Skiff
*Attorney, Agent, or Firm*—Michael J. Striker

[57] ABSTRACT

An improved method for the manufacture of hot strips or heavy plates from a denitrated steel composed of 0.04 to 0.16% carbon, 1.25 to 1.90% manganese, 0.2 to 0.55% silicon, 0.004 to 0.020% phosphorus, 0.002 to 0.015% sulfur, 0.02 to 0.08% aluminum, 0.02 to 0.08% niobium, the remainder iron and possibly contaminants, including the steps of having the hot strips or plates leaving the last finishing stand of rolls at a temperature of 750° C. to 820° C., cooling the hot strips or plates to an intermediates temperature of 450° C. to 500° C. at a cooling rate of 2° to 10° C./s and then slowly cooling the hot strips or plates in air to room temperature in a coil or in a pile.

13 Claims, 7 Drawing Figures

HOT STRIPS OR HEAVY PLATES FROM A DENITRATED STEEL AND METHOD FOR THEIR MANUFACTURE

BACKGROUND OF THE INVENTION

The invention concerns a method for the manufacture of hot strips or heavy plates from a denitrated steel.

For a long time the demand continued for the development of higher strength steels with high toughness values at low temperature, in the form of hot strips or heavy plates. These are used, for example, in large diameter long-distance pipelines. Controlled hot rolling has been used more and more as an economical method for the production of thermo-mechanically treated hot strips or heavy plates. As part of a thermo-mechanical treatment for steels it is understood to effect a controlled transformation of the steel in a temperature range around the transformation point $A_{r3}$ with a simultaneously controlled cooling and/or transformation of the structure.

It is known to use denitrated steel with a composition of 0.04 to 0.16% carbon, 1.25 to 1.90% manganese, 0.02 to 0.55% silicon, 0.004 to 0.020% phosphorus, 0.002 to 0.015% sulfur, 0.02 to 0.08% aluminum, 0.2 to 0.08% niobium, the remainder being iron and possibly contaminants. The steel can also be alloyed with the addition of 0.015 to 0.35% molybdenum, 0.10 to 0.30% chromium and/or 0.30 to 0.90% nickel, alone or in combination.

During the mechanical-technological testing of these steels, particularly with the presence of notches and over a wide temperature range, one frequently observes splits perpendicular to the fracture surface in the upper part of the complete brittle failure stage. These are designated "separations", "cleavage" or "splitting". This tendency of splitting at the fracture surface of thermo-mechanically treated steel is, for example, of significance in the operation of large diameter long-distance pipelines, since the capacity of these steels to stop fracture propagation is thereby reduced.

Proposals have already been made for the production of higher strength steels for use in large diameter long-distance pipelines in which splitting at the fracture during the notch impact testing is no longer found. However, high alloying and manufacturing costs are connected with all of them. For example, it is recommended in De-OS No. 26 53 847 to alloy the steel by up to 3.5% or 2.5% addition of chromium and manganese, after the steel has been subjected to a nitrogen enrichment up to a content of 0.012%. Furthermore the hot rolling of this steel is complicated. The rolled stock will be subjected to a deformation from 30 to 60% at temperatures between 950° C. and 1100° C., a subsequent prescribed interruption of hot rolling and a deformation of 75 to 95% of the original thickness at temperatures between 700° C. and 900° C. The deformed structure will finally be converted into the lower bainite stage. The alloying of the chromium and manganese additions raises the price of the known steels considerably. On account of the complicated and expensive rolling operation further increased manufacturing costs arise.

SUMMARY OF THE INVENTION

The object of the invention is to obtain an increased notch impact toughness for hot-rolled hot strips or heavy plates through a controlling of the occurrence of separations.

A further object of the present invention is to obtain such an increased notch impact toughness at low temperatures, that is to have a CVN-transition temperature $TU_{50}$ of at least −30° C.

These objects will be achieved according to the present invention by subjecting a steel of composition 0.04 to 0.16% carbon, 1.25 to 1.90% manganese, 0.02 to 0.55% silicon, 0.004 to 0.020% phosphorus, 0.002 to 0.015% sulfur, 0.02 to 0.08% aluminum, 0.02 to 0.08% niobium, the remainder iron and possibly contaminants, to a hot-rolling operation in which the hot strip or the plate leaves the last finishing stand of rolls with a temperature of 750° and 820° C., is cooled at a rate of 2° to 10° C. per second to an intermediate temperature of 450° C. to 570° C., and is at this temperature coiled or placed in a pile for further cooling.

Surprisingly, it turns out that only upon the observance of the described, relatively simple hot-rolling operations for the mentioned steel will there appear a significant reduction in splitting at the fracture during the CVN-notch impact test (CVN: Charpy-V-Notch) at CVN-transition temperatures as low as −30° C., and therewith a considerably increased notch impact toughness.

Following the method according to the invention the usefulness of the steel, for example in large diameter long-distance pipelines, can be considerably improved without the necessity of excessive alloying.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

It turns out that a particularly favorable enhancement in the strength characteristics of steel produced according to the present invention is obtained with the addition of 0.02 to 0.10% vanadium, since the precipitations of vanadium carbonitrites occur mainly in the ferrite grain and not at the grain boundaries.

Observance of an intermediate temperature of 450° C. to 500° C. allows for completely avoiding the formation of separations. The steel exhibits a ferritic-pearlitic structure and the ratio of Cvmax to Cv100 lies between 1.0 and 1.3. Cv100 signifies the minimum notch impact value of the upper shelf which will show a 100% ductile fracture. Cvmax is the value, in dependence on the temperature, at which the highest notch impact toughness for the entire test is produced. The steel manufactured according to the present invention displays a complete lack of fracture splitting in the CVN-notch impact tests (CVN: Charpy-V-Notch) and simultaneously CVN-transition temperatures of as low as −30° C.

Figure 1:
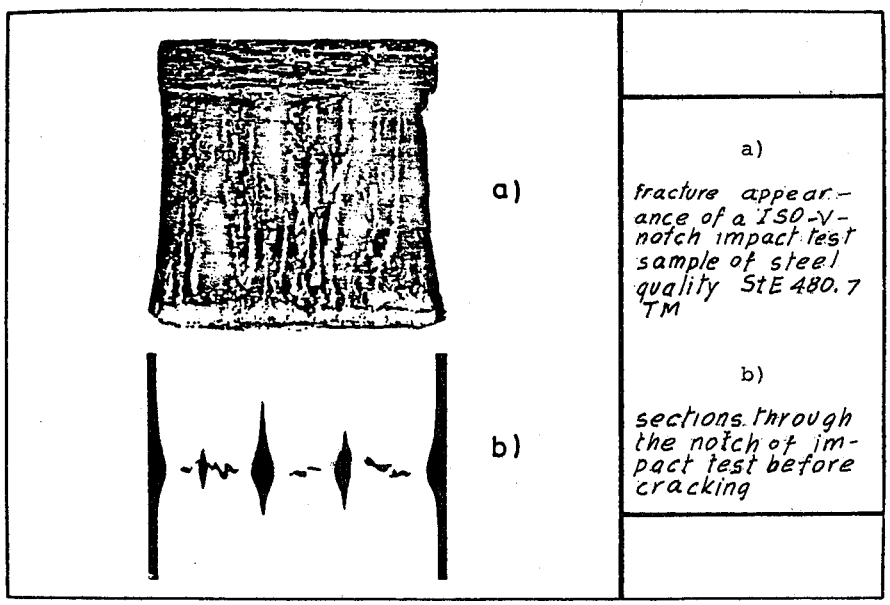
FIG. 1 is a photo of a fracture struck in a notch impact test.

With the observance of an intermediate temperature of 500° C. to 570° C., steel of the mentioned composition exhibits a decreased number of separations. Nevertheless it still displays a substantially increased notch impact toughness values. Notch impact toughness tests involving hot strips and/or plates afflicted with separations have shown that with increased number of "separations" in the fracture surface of the CVN-tests the notch impact toughness (in $J/cm^2$) decreases. The basis for this decrease in the notch impact toughness lies in the fact that the separations proceed perpendicular to the main fracture surface and parallel to the sample surface, particularly before the spreading of the main tear begins, as is evident from FIG. 1, so that a small amount of energy is required for the begin of yielding, which occurs during bending of the samples in the course of the notch impact test. This is of significance to the extent that material "free of separations" having highest notch impact toughness values, are not always required for the production of hot strips or plates, so that use is found for material with some slight number of "separations", however with increased notch impact toughness. A material of that kind will be obtained with the observance of an intermediate temperature from 500° to 570° C.

A steel with additions of 0.15 to 0.35% molybdenum, 0.10 to 0.35% chromium and/or 0.30 to 0.90% nickel, alone or in combination, suffices for the production of a "separations-free" material if the same cooling conditions of 2° to 10° C./sec also to an intermediate temperature of 550° C. are retained, so that the cooling need ensue only to this temperature.

For the production of a steel with said alloying, displaying a reduced number of separations but an increased notch impact toughness, it is sufficient if the intermediate temperature amounts to 550° C. to 620° C. and the finishing temperatures are lying between 750° C. and 850° C.

Figure 2:
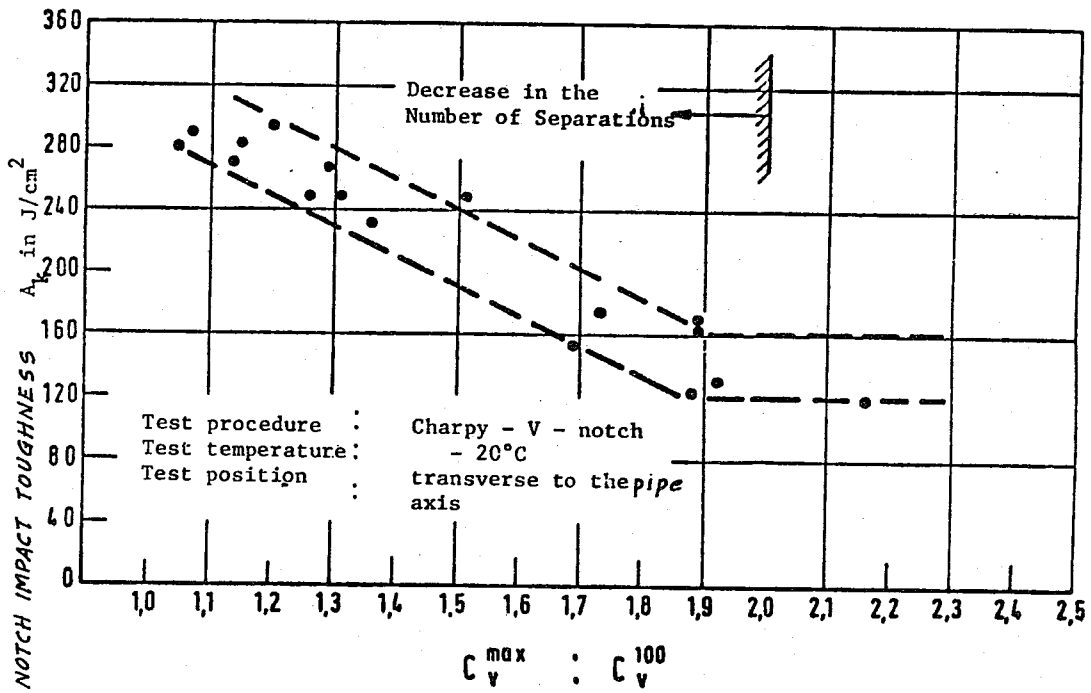
FIG. 2 is a graph relating notch impact toughness values (ordinate) to the ratio Cvmax: Cv100 (abscissa).
Figure 3:
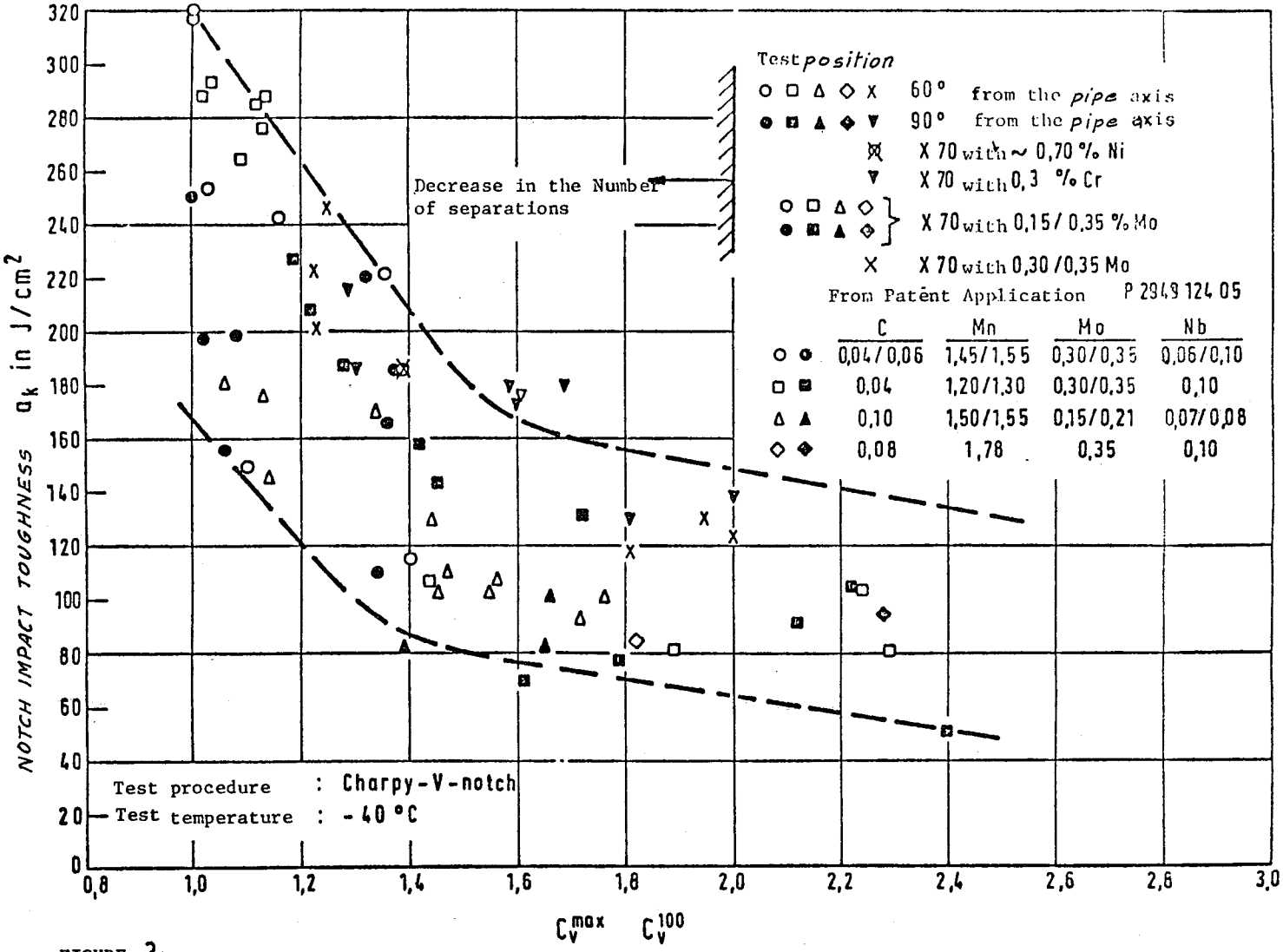
FIG. 3 is analogous to FIG. 2, using steels of various composition.
Figure 4:
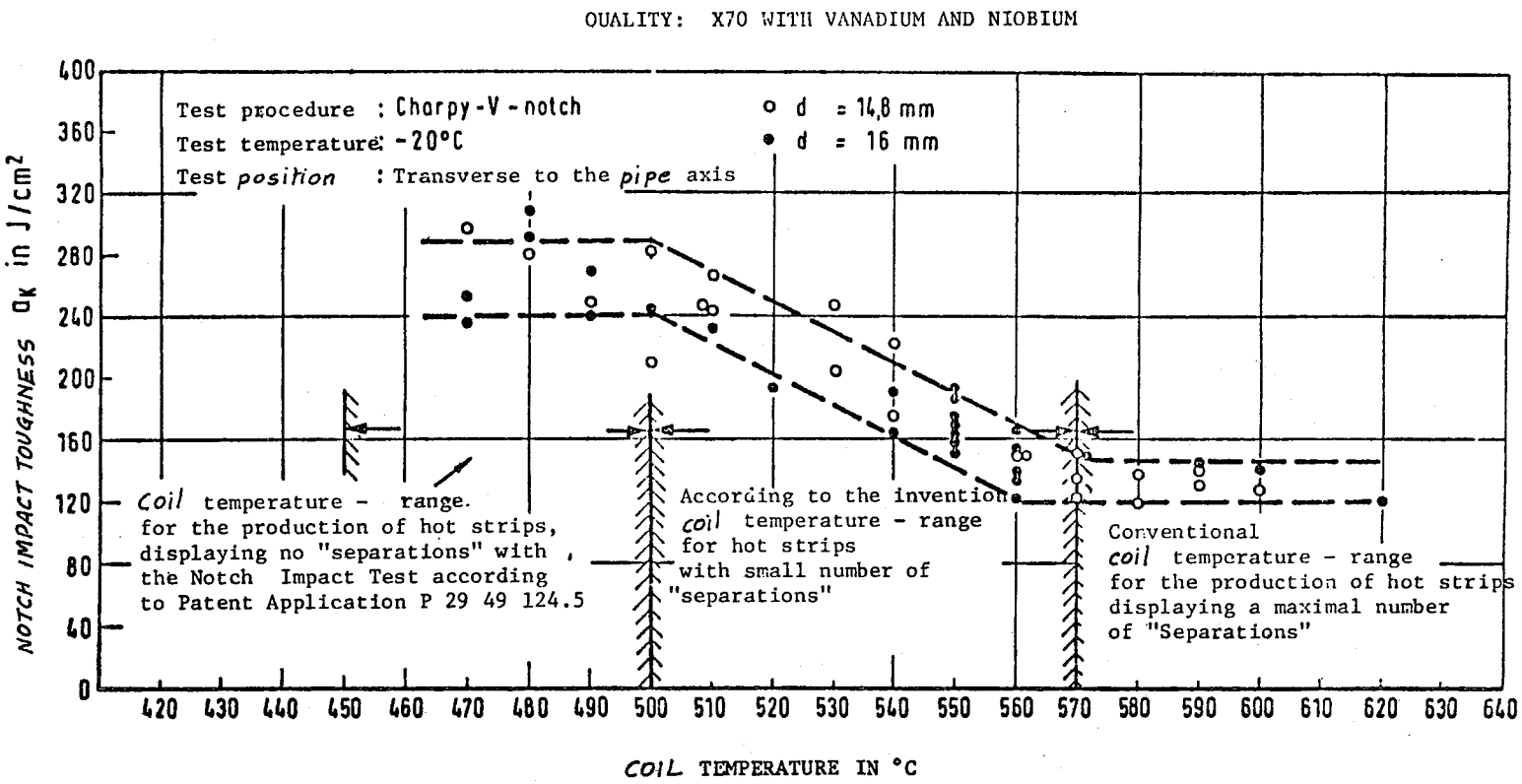
FIGS. 4 and 6 are graphs relating notch impact toughness values to coiling temperature.
Figure 5:
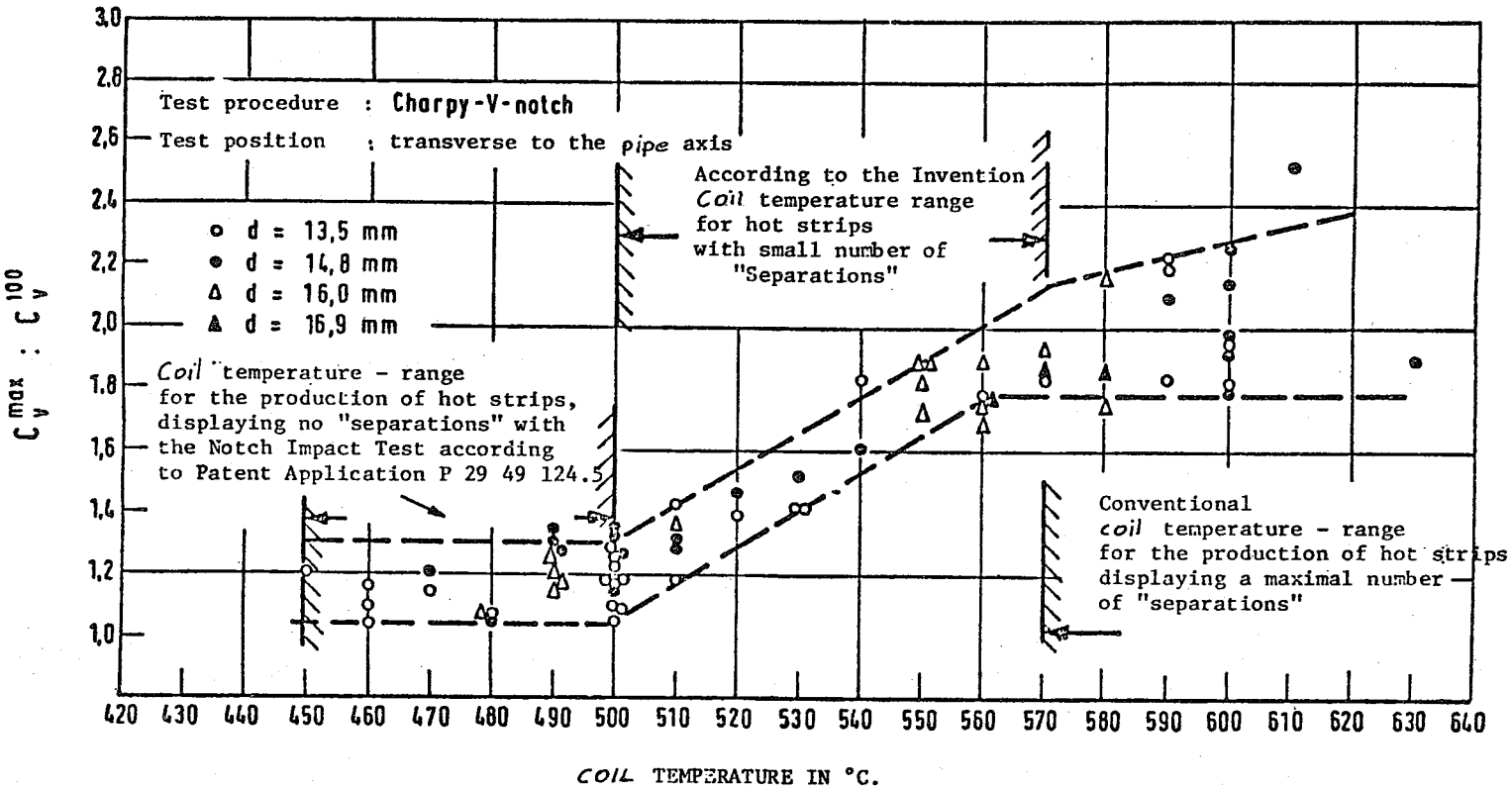
FIGS. 5 and 7 are graphs relating the ratio Cvmax:Cv100 to coiling temperature.
Figure 6:
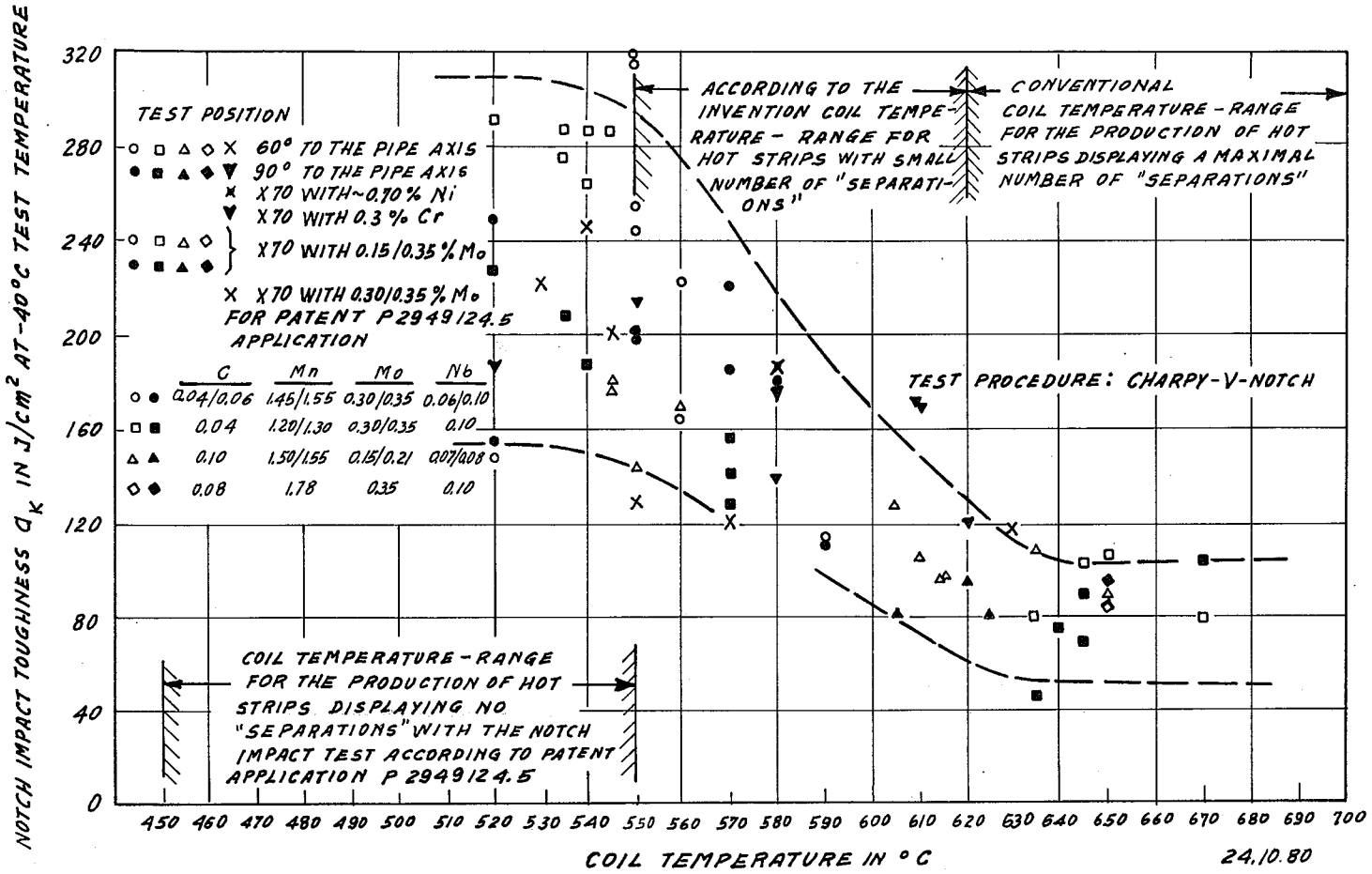
Figure 7:
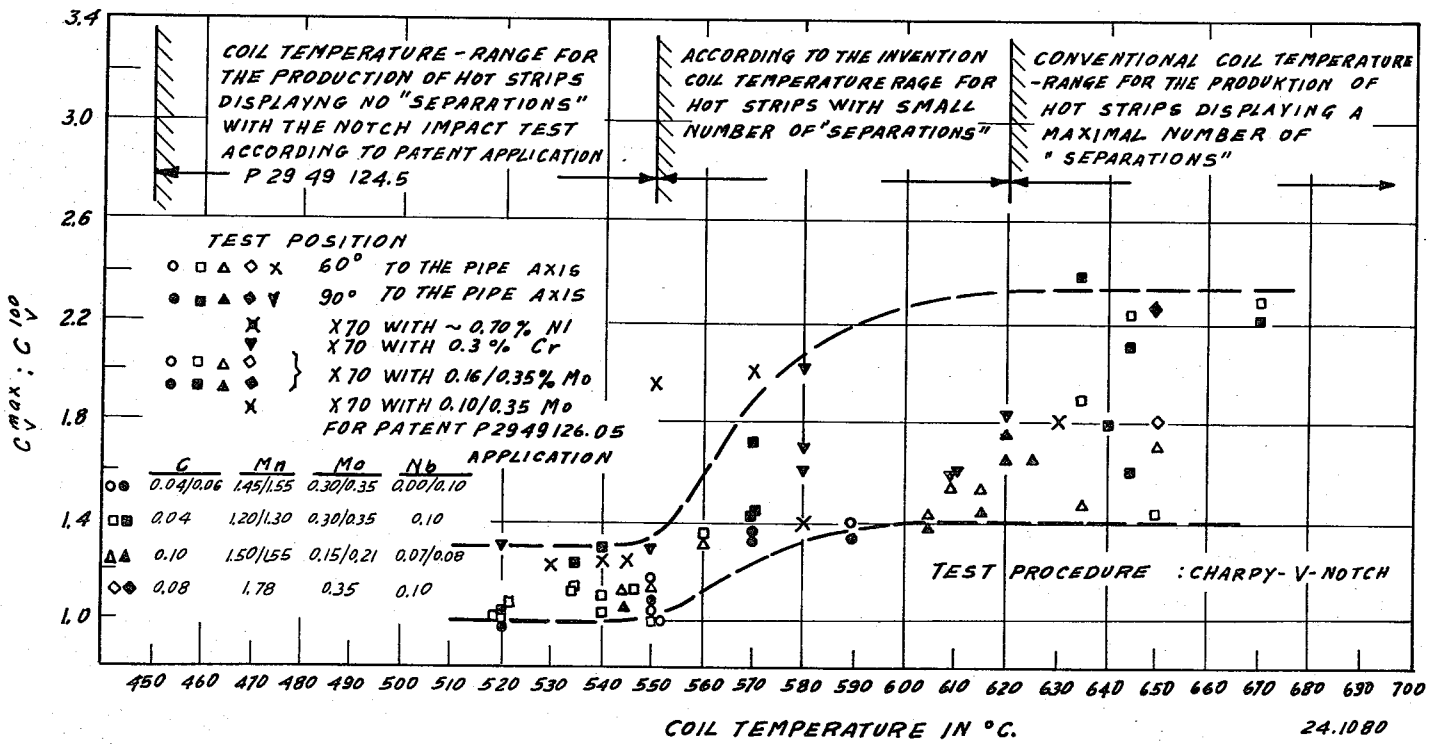

The advantage of a reduction in the number of "separations" insofar as the notch impact test is concerned is seen clearly in FIGS. 2 and 3.

For example, decrease in the ratio Cvmax to Cv100 from about 2.0 at a value of 1.3 corresponds to an increase in the notch impact toughness values in cross-section from 150 $J/cm^2$ to about 230 $J/cm^2$ among X70 quality steels alloyed with addition of molybdenum, chromium or nickel (FIG. 3), and from 160 $J/cm^2$ to 280 $J/cm^2$ for niobium-vanadium-containing steels of X70 quality (FIG. 2), which correspond to an increase in the notch impact toughness of 53 and 75% respectively. The representation of notch impact toughness as a function of the ratio of Cvmax to Cv100 was for that reason selected for FIGS. 2 and 3 since the ratio of Cvmax to Cv100 responds more sharply to the number of separations than to all other parameters.

The steels of Tables 1 and 2 were made in an oxygen blowing converter, and were rolled into hot strips or heavy plates according to the conditions indicated in Tables 3, 4 and 5.

The results obtained, represented additionally in FIGS. 4 and 5 or FIGS. 6 and 7, indicate that a distinct increase in notch impact toughness is realized in contrast to the customarily hot rolled microalloyed steels.

It was established that the temperature at which the hot strip or plate leaves the last finishing stand is not required to be as completely confined for a separations reduced steel according to the present invention as for the manufacture of a separations-free steel. A temperature range of 750° to 850° C. is possible.

According to the invention performance of the new methods with an intermediate temperature from 550° to 620° C. can be accomplished also with further addition of 0.002 to 0.08% zirconium and/or 0.004 to 0.051% cerium.

For the manufacture of separations-free steels, tests were carried out on eleven types of steel with different carbon contents and combinations of microalloying additives niobium, vanadium, nickel and chromium.

The compositions of the steels are indicated in Table 6, in which fractions of the components contained in the steel are given in percent. The melt numbers serve merely for identification of the steel.

The steels were manufactured according to the parameters given in Table 7. The outlet thickness, the thickness of the rolled steel plates, the pusher furnace temperature, the finishing temperature and the temperature after the controlled cooling (coiling temperature) are given. In all cases with the exception of sheet A the steel was coiled up. The last column gives the cooling rate from the finishing stand temperature (WET) to the coiling temperature ($T_H$) in °C./sec. In the coil the steel was then cooled down slowly, for example at a rate of about 0.5° C./hour.

The mechanical-technological characteristics of the examined and separations-free steels are summarized in Table 8. The letters "L" and "Q" characterize the test positions with regard to the direction of rolling, namely "L" a length test and "Q" a transverse test, for which the notch impact test was conducted. The further three columns contain the usual statements concerning yielding stress and tensile strength. The $a_k$-value gives the energy absorption of the steel at different points on the $a_k$-curve as a function of the temperature. Cv100 characterizes the energy absorption at the minimum temperature at which a complete ductile fracture is instituted. Cvmax characterizes the maximum energy absorption, whereas $TU_{50}$ is for the temperature at which in the transition region between brittle fracture and ductile fracture of the Charpy-V-notch impact test according to German Industrial Specification DIN 50.115, 50% ductile fracture is exhibited in the fracture surface.

The next two columns give the transition temperature for Cv100 and $TU_{50}$. It is evident that $TU_{50}$ always lies considerably below −30° C., so that a high toughness is also guaranteed at minimum temperatures. The steel distinguishes itself by a high energy absorption. With the separations-free steel according to the invention the quotient Cvmax to Cv100 is situated close to 1, namely between 1 and 1.3. All of the steels are free of separations perpendicular to the fracture surface.

Whereas Tables 1 to 5 have to do with separations-poor steels according to the invention having a high notch impact toughness, Tables 6 to 8 characterize separations-free steels that, according to constitution, display a very high notch impact toughness.

It will be understood that each of the elements described above, or two or more together, may also find a useful application in other types of steel differing from the types described above.

While the invention has been illustrated and described as embodied in hot strips or heavy plates from a denitrated steel, and methods for their manufacture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

TABLE 1

| | Chemical Composition of the Tested Steels in % | | | | | | | | |
|---|---|---|---|---|---|---|---|---|---|
| Melt Nr. | C | Si | Mn | P | S | Al | N | V | Nb |
| 67649 | 0,11 | 0,34 | 1,61 | 0,019 | 0,008 | 0,039 | 0,0058 | 0,09 | 0,04 |
| 38069 | 0,10 | 0,35 | 1,59 | 0,021 | 0,013 | 0,051 | 0,0057 | 0,08 | 0,04 |
| 38070 | 0,10 | 0,39 | 1,59 | 0,016 | 0,012 | 0,041 | 0,0072 | 0,09 | 0,05 |
| 39907 | 0,10 | 0,27 | 1,54 | 0,020 | 0,013 | 0,037 | 0,0057 | 0,07 | 0,04 |
| 10527 | 0,09 | 0,26 | 1,58 | 0,015 | 0,003 | 0,051 | 0,0107 | 0,07 | 0,03 |
| 44359 | 0,09 | 0,24 | 1,49 | 0,014 | 0,004 | 0,039 | 0,0108 | 0,06 | 0,03 |
| 10381 | 0,09 | 0,33 | 1,58 | 0,015 | 0,011 | 0,059 | 0,0080 | 0,09 | 0,04 |
| 10179 | 0,11 | 0,37 | 1,55 | 0,020 | 0,009 | 0,055 | 0,0040 | 0,09 | 0,05 |
| 43940 | 0,11 | 0,31 | 1,53 | 0.017 | 0,010 | 0,051 | 0,0072 | 0,08 | 0,05 |
| 43941 | 0,10 | 0,29 | 1,54 | 0,016 | 0,012 | 0,041 | 0,0057 | 0,08 | 0,05 |
| 67008 | 0,11 | 0,31 | 1,59 | 0,021 | 0,012 | 0,028 | 0,0057 | 0,08 | 0,05 |
| 67138 | 0,12 | 0,37 | 1,62 | 0,016 | 0,007 | 0,067 | 0,0072 | 0,09 | 0,06 |
| 11608 | 0,10 | 0,38 | 1,56 | 0,020 | 0,003 | 0,049 | 0,0106 | 0,08 | 0,04 |
| 11798 | 0,09 | 0,38 | 1,56 | 0,015 | 0,002 | 0,037 | 0,0084 | 0,08 | 0,04 |
| 46277 | 0,09 | 0,39 | 1,62 | 0,018 | 0,005 | 0,044 | 0,0077 | 0,08 | 0,04 |
| 46279 | 0,10 | 0,39 | 1,61 | 0,020 | 0,004 | 0,036 | 0,0091 | 0,07 | 0,04 |
| 46366 | 0,08 | 0,36 | 1,60 | 0,020 | 0,006 | 0,048 | 0,0061 | 0,07 | 0,04 |
| 46368 | 0,09 | 0,36 | 1,60 | 0,020 | 0,004 | 0,045 | 0,0088 | 0,07 | 0,04 |
| 71445 | 0,10 | 0,37 | 1,62 | 0,015 | 0,002 | 0,050 | 0,0089 | 0,09 | 0,04 |
| 71451 | 0,09 | 0,39 | 1,55 | 0,019 | 0,002 | 0,030 | 0,0089 | 0,08 | 0,04 |
| 71548 | 0,09 | 0,33 | 1,57 | 0,015 | 0,004 | 0,037 | 0,0086 | 0,08 | 0,04 |
| 71915 | 0,10 | 0,38 | 1,58 | 0,018 | 0,003 | 0,031 | 0,0092 | 0,08 | 0,05 |
| 72148 | 0,09 | 0,38 | 1,61 | 0,018 | 0,004 | 0,051 | 0,0077 | 0,07 | 0,04 |
| 72255 | 0,09 | 0,35 | 1,65 | 0,020 | 0,007 | 0,039 | 0,0124 | 0,08 | 0,04 |

TABLE 2

| | Chemical Composition of the Tested Steels in % | | | | | | | | | | | | | |
|---|---|---|---|---|---|---|---|---|---|---|---|---|---|---|
| Warmband | C | Si | Mn | P | S | N | Al | Nb | V | Mo | Cer | Zr | Cr | Remarks |
| 817/21 | 0,10 | 0,32 | 1,53 | 0,026 | 0,012 | 0,0068 | 0,036 | 0,07 | 0,04 | 0,16 | — | — | — | The chemical composition of hot strips S, T, U, C, D and E is given in applicants' German priority application P 29 49 124.5 |
| 817/22 | 0,10 | 0,33 | 1,55 | 0,029 | 0,013 | 0,0069 | 0,036 | 0,08 | 0,04 | 0,15 | — | — | — | |
| 817/26 | 0,10 | 0,33 | 1,54 | 0,027 | 0,012 | 0,0070 | 0,036 | 0,07 | 0,04 | 0,15 | — | — | — | |
| 817/27 | 0,10 | 0,32 | 1,50 | 0,025 | 0,014 | 0,0072 | 0,034 | 0,10 | 0,06 | 0,21 | — | — | — | |
| 817/30 | 0,10 | 0,33 | 1,51 | 0,016 | 0,011 | 0,0076 | 0,044 | 0,07 | 0,04 | 0,15 | — | — | — | |
| 886/31 | 0,04 | 0,29 | 1,26 | 0,026 | 0,008 | 0,0063 | 0,034 | 0,09 | — | 0,33 | 0,051 | — | — | |
| 886/33 | 0,04 | 0,29 | 1,23 | 0,021 | 0,008 | 0,0058 | 0,033 | 0,08 | — | 0,33 | 0,005 | — | — | |
| 886/34 | 0,04 | 0,29 | 1,27 | 0,023 | 0,009 | 0,0058 | 0,034 | 0,09 | — | 0,33 | 0,004 | — | — | |
| 93861 | 0,04 | 0,30 | 1,27 | 0,023 | 0,008 | 0,0055 | 0,031 | 0,09 | — | 0,35 | — | — | — | |
| 93859 | 0,08 | 0,35 | 1,76 | 0,015 | 0,010 | 0,0059 | 0,048 | 0,10 | — | 0,34 | — | — | — | |
| 907022 bis 907024 | 0,07 | 0,26 | 1,68 | 0,019 | 0,004 | 0,0084 | 0,048 | 0,04 | 0,06 | — | — | — | 0,30 | |
| 995211 | 0,07 | 0,21 | 1,41 | 0,017 | 0,008 | 0,0067 | 0,035 | 0,06 | — | 0,33 | — | — | — | |
| 995213 | 0,07 | 0,22 | 1,46 | 0,020 | 0,009 | 0,0061 | 0,028 | 0,06 | — | 0,34 | — | — | — | |
| 995214 | 0,04 | 0,18 | 1,55 | 0,014 | 0,008 | 0,0082 | 0,036 | 0,06 | — | 0,29 | — | 0,002 | — | |
| 995215 | 0,06 | 0,23 | 1,47 | 0,021 | 0,009 | 0,0058 | 0,038 | 0,06 | — | 0,34 | — | — | — | |
| 0849/03 K* | 0,13 | 0,35 | 1,60 | 0,019 | 0,002 | 0,0104 | 0,060 | 0,03 | — | — | — | — | — | *contains additionally 0.69% Ni |
| 995219 | 0,04 | 0,18 | 1,51 | 0,013 | 0,007 | 0,0074 | 0,047 | 0,07 | — | 0,36 | — | 0,07 | — | |
| 995225 | 0,04 | 0,20 | 1,51 | 0,013 | 0,008 | 0,0064 | 0,051 | 0,07 | — | 0,37 | — | 0,07 | — | |

TABLE 3

| Nr. | Hot Strip and/or Heavy Plate | Thickness in mm | CVN-$a_k$-Value in J/cm² at −20° C. | CVN-$a_k$-Value in J/cm² at Maximum | $\frac{C_V^{max}}{C_V^{100}}$ | Finishing temperature in °C. | Coil or pile temp. in °C. | ΔT in °C. | Cooling rate °C./s | REMARKS |
|---|---|---|---|---|---|---|---|---|---|---|
| 1 | 2 | 3 | 4 | 5 | 6 | 7 | 8 | 9 | 10 | 11 |
| 1 | 691160 | 13,5 | 113 | 164 | 1,82 | 790 | 540 | 250 | 7,20 | Melt 67649 |
| 2 | " | 13,5 | 103 | 155 | 1,78 | 790 | 560 | 230 | 6,65 | |
| 3 | " | 13,5 | 104 | 148 | 1,83 | 790 | 570 | 220 | 6,4 | |
| 4 | 702339 | 13,5 | 128 | 137 | 1,23 | 790 | 520 | 270 | 7,7 | Melt 38069 |
| 5 | " | 13,5 | 125 | 134 | 1,07 | 790 | 480 | 290 | 8,9 | |
| 6 | " | 13,5 | 123 | 129 | 1,05 | 790 | 500 | 290 | 8,3 | |
| 7 | " | 13,5 | 125 | 130 | 1,04 | 800 | 460 | 340 | 9,5 | |
| 8 | 702340 | 13,5 | 143 | 145 | 1,18 | 790 | 510 | 280 | 8,0 | |
| 9 | " | 13,5 | 126 | 150 | 1,19 | 790 | 500 | 290 | 8,3 | |
| 10 | " | 13,5 | 126 | 149 | 1,18 | 790 | 500 | 290 | 8,3 | |
| 11 | " | 13,5 | 121 | 140 | 1,16 | 790 | 460 | 330 | 9,5 | |
| 12 | 702341 | 13,5 | 124 | 137 | 1,10 | 790 | 500 | 290 | 8,3 | |

TABLE 3-continued

| Nr. | Hot Strip and/or Heavy Plate | Thickness in mm | CVN-$a_k$-Value in J/cm² at −20° C. | Maximum | $\frac{C_V^{max}}{C_V^{100}}$ | Finishing temperature in °C. | Coil or pile temp. in °C. | ΔT in °C. | Cooling rate °C./s | REMARKS |
|---|---|---|---|---|---|---|---|---|---|---|
| 1 | 2 | 3 | 4 | 5 | 6 | 7 | 8 | 9 | 10 | 11 |
| 13 | " | 13,5 | 126 | 137 | 1,09 | 790 | 500 | 290 | 8,3 | |
| 14 | " | 13,5 | 125 | 143 | 1,14 | 790 | 470 | 320 | 9,1 | |
| 15 | " | 13,5 | 114 | 137 | 1,20 | 800 | 450 | 350 | 9,4 | |
| 16 | 725534 | 13,5 | 158 | 172 | 1,42 | 780 | 510 | 270 | 8,0 | |
| 17 | 725535 | 13,5 | 155 | 173 | 1,29 | 790 | 500 | 290 | 8,3 | Melt 38070 |
| 18 | 725536 | 13,5 | 158 | 173 | 1,09 | 800 | 460 | 340 | 9,5 | |
| 19 | 725545 | 13,5 | 88 | 136 | 2,19 | 790 | 590 | 200 | 6,00 | Melt 38070 |
| 20 | 725546 | 13,5 | 91 | 149 | 2,22 | 780 | 590 | 190 | 6,00 | |
| 21 | 749682 | 13,5 | 84 | 132 | 1,94 | 790 | 600 | 190 | 5,80 | |
| 22 | " | 13,5 | 80 | 130 | 1,83 | 790 | 590 | 200 | 6,00 | |
| 23 | " | 13,5 | 77 | 123 | 1,81 | 780 | 600 | 180 | 6,00 | |
| 24 | 749684 | 13,5 | 127 | 149 | 1,41 | 800 | 530 | 270 | 7,4 | |
| 25 | " | 13,5 | 109 | 131 | 1,39 | 790 | 520 | 270 | 7,7 | Melt 39907 |
| 26 | " | 13,5 | 107 | 130 | 1,41 | 800 | 530 | 270 | 7,4 | |
| 27 | 749685 | 13,5 | 110 | 129 | 1,17 | 790 | 500 | 290 | 8,3 | |
| 28 | " | 13,5 | 111 | 132 | 1,19 | 790 | 490 | 300 | 8,60 | |
| 29 | " | 13,5 | 116 | 145 | 1,25 | 790 | 500 | 290 | 8,3 | |
| 30 | 996962 | 14,8 | 285 | 329 | 1,60 | 770 | 540 | 230 | 5,95 | Melt 10527 |
| 31 | " | 14,8 | 296 | 314 | 1,20 | 780 | 470 | 310 | 7,80 | |
| 32 | 996963 | 14,8 | 247 | 276 | 1,51 | 780 | 530 | 250 | 6,20 | Melt 44359 |
| 33 | 996964 | 14,8 | 282 | 300 | 1,15 | 760 | 500 | 260 | 7,00 | |
| 34 | " | 14,8 | 281 | 290 | 1,05 | 770 | 480 | 290 | 7,60 | |
| 35 | 996966 | 14,8 | 266 | 302 | 1,29 | 780 | 510 | 270 | 6,75 | Melt 10527 |
| 36 | " | 14,8 | 246 | 281 | 1,31 | 780 | 510 | 270 | 6,75 | |
| 37 | 857749 | 14,8 | 89 | 142 | 1,89 | 780 | 630 | 150 | 4,20 | Melt 1038 |
| 38 | 857750 | 14,8 | 89 | 135 | 2,14 | 780 | 600 | 180 | 4,70 | Melt 1017 |
| 39 | 857751 | 14,8 | 84 | 140 | 1,92 | 790 | 600 | 190 | 4,70 | |
| 40 | 857752 | 14,8 | 104 | 167 | 1,80 | 780 | 600 | 180 | 4,7 | Melt 4394 |
| 41 | 857754 | 14,8 | 152 | 180 | 1,46 | 760 | 520 | 240 | 6,50 | Melt 1038 |
| 42 | 857755 | 14,8 | 143 | 191 | 1,34 | 780 | 500 | 280 | 7,00 | Melt 1017 |
| 43 | 857756 | 14,8 | 157 | 185 | 1,30 | 770 | 490 | 280 | 7,15 | Melt 4394 |
| 44 | 857764 | 14,8 | 201 | 201 | 1,26 | 770 | 500 | 270 | 7,00 | Melt 1038 |
| 45 | 857765 | 14,8 | 163 | 174 | 1,32 | 760 | 500 | 260 | 7,00 | Melt 1017 |
| 46 | 857766 | 14,8 | 156 | 185 | 1,34 | 770 | 490 | 280 | 7,15 | |
| 47 | 857767 | 14,8 | 176 | 199 | 1,28 | 770 | 490 | 280 | 7,15 | Melt 4394 |
| 48 | 857768 | 14,8 | 129 | 188 | 2,09 | 780 | 590 | 190 | 4,75 | Melt 1038 |
| 49 | 857769 | 14,8 | 128 | 191 | 1,97 | 770 | 600 | 170 | 4,70 | |
| 50 | 857770 | 14,8 | 101 | 164 | 2,25 | 780 | 600 | 180 | 4,70 | Melt 1019 |
| 51 | 857771 | 14,8 | 119 | 184 | 2,52 | 790 | 610 | 180 | 4,50 | |
| 52 | 878523 | 16,0 | 118 | 145 | 2,16 | 790 | 580 | 210 | 4,55 | Melt 1160 |
| 53 | 997273 | 16,0 | 122 | 137 | 1,88 | 790 | 560 | 230 | 5,00 | Melt 7144 |
| 54 | 997300 | 16,0 | 169 | 199 | 1,89 | 790 | 550 | 240 | 5,30 | Melt 7145 |
| 55 | 880162 | 16,0 | 134 | 182 | 1,92 | 780 | 570 | 210 | 4,70 | Melt 11608 |
| 56 | 997321 | 16,0 | 175 | 201 | 1,73 | 770 | 550 | 220 | 5,30 | Melt 71548 |
| 57 | 903190 | 16,0 | 232 | 277 | 1,36 | 790 | 510 | 280 | 6,40 | Melt 72148 |
| 58 | 903195 | 16,0 | 289 | 290 | 1,07 | 800 | 480 | 320 | 7,40 | Melt 11789 |
| 59 | 903202 | 16,0 | 165 | 234 | 1,89 | 800 | 550 | 250 | 5,30 | Melt 71915 |
| 60 | 903203 | 16,0 | 247 | 253 | 1,26 | 790 | 490 | 300 | 7,0 | |
| 61 | 903231 | 16,0 | 154 | 210 | 1,69 | 810 | 560 | 250 | 5,00 | Melt 46279 |
| 62 | 906978 | 16,0 | 176 | 228 | 1,74 | 760 | 580 | 180 | 4,65 | Melt 46366 |
| 63 | 906992 | 16,0 | 217 | 237 | 1,21 | 790 | 490 | 300 | 7,00 | Melt 46277 |
| 64 | 906998 | 16,0 | 181 | 224 | 1,76 | 790 | 560 | 230 | 5,00 | |
| 65 | 909470 | 16,0 | 137 | 216 | 1,83 | 790 | 550 | 240 | 5,30 | Melt 72255 |
| 66 | 909484 | 16,0 | 269 | 280 | 1,14 | 780 | 490 | 290 | 7,00 | Melt 46368 |
| 67 | 670103 | 16,9 | 93 | 139 | 1,85 | 800 | 580 | 220 | 4,20 | |
| 68 | 670105 | 16,9 | 107 | 160 | 1,86 | 790 | 570 | 220 | 4,45 | Melt 67008 |
| 69 | 670107 | 16,9 | 117 | 159 | 1,97 | 790 | 560 | 230 | 4,65 | |
| 70 | 675840 | 16,9 | 184 | 232 | 1,18 | 800 | 490 | 310 | 6,90 | Melt 67138 |

TABLE 4

| Nr. 1 | Hot Strip and/or Heavy Plate 2 | CVN-Value in J/cm² at −20° C. 3 | Coil or pile temp. in °C. 4 | Chemical Composition in % C 5 | Si 6 | Mn 7 | P 8 | S 9 | Al 10 | N 11 | V 12 | Nb 13 | Thickness in mm 14 | Cooling rate °C./s 15 | Melt Nr. 16 |
|---|---|---|---|---|---|---|---|---|---|---|---|---|---|---|---|
| 1 | 878513 | 119 | 620 | 0,10 | 0,36 | 1,60 | 0,017 | 0,002 | 0,038 | 0,0110 | 0,08 | 0,04 | 16,0 | 3,80 | 11606 |
| 2 | 878523 | 118 | 580 | | | | | | | | | | 16,1 | 4,50 | |
| 3 | 880162 | 134 | 570 | 0,10 | 0,38 | 1,56 | 0,020 | 0,003 | 0,049 | 0,0106 | 0,08 | 0,04 | 16,0 | 4,75 | 11608 |
| 4 | 880162 | 124 | 570 | | | | | | | | | | 16,3 | 4,60 | |
| 5 | 902083 | 138 | 580 | 0,10 | 0,37 | 1,55 | 0,017 | 0,003 | 0,042 | 0,0065 | 0,08 | 0,04 | 15,9 | 4,55 | 11796 |
| 6 | 902058 | 191 | 540 | 0,10 | 0,36 | 1,57 | 0,016 | 0,002 | 0,029 | 0,0064 | 0,07 | 0,04 | 15,9 | 5,60 | 11797 |
| 7 | 903195 | 307 | 480 | 0,09 | 0,38 | 1,56 | 0,015 | 0,002 | 0,037 | 0,0084 | 0,08 | 0,04 | 16,3 | 7,30 | 11798 |
| 8 | 903195 | 289 | 480 | | | | | | | | | | 16,1 | 7,40 | |
| 9 | 907001 | 175 | 550 | 0,10 | 0,36 | 1,59 | 0,018 | 0,004 | 0,032 | 0,0092 | 0,07 | 0,04 | 16,0 | 5,30 | 46278 |
| 10 | 903231 | 151 | 560 | 0,10 | 0,39 | 1,61 | 0,020 | 0,004 | 0,036 | 0,0091 | 0,07 | 0,04 | 16,0 | 5,00 | 46279 |
| 11 | 903231 | 154 | 560 | | | | | | | | | | 16,1 | 4,95 | |
| 12 | 906983 | 167 | 560 | 0,09 | 0,36 | 1,60 | 0,020 | 0,004 | 0,045 | 0,0088 | 0,07 | 0,04 | 16,3 | 4,90 | 46368 |
| 13 | 909484 | 269 | 490 | | | | | | | | | | 15,9 | 7,0 | |
| 14 | 997273 | 122 | 560 | 0,10 | 0,37 | 1,62 | 0,015 | 0,002 | 0,050 | 0,0089 | 0,09 | 0,04 | 16,1 | 4,95 | 71445 |
| 15 | 880171 | 252 | 470 | | | | | | | | | | 16,3 | 7,90 | |
| 16 | 997278 | 139 | 560 | 0,09 | 0,32 | 1,60 | 0,018 | 0,004 | 0,033 | 0,0081 | 0,08 | 0,04 | 15,9 | 5,10 | 71446 |
| 17 | 880174 | 236 | 470 | 0,10 | 0,38 | 1,66 | 0,020 | 0,002 | 0,050 | 0,0089 | 0,08 | 0,04 | 16,1 | 7,70 | 71450 |
| 18 | 880174 | 240 | 490 | 0,10 | 0,38 | 1,66 | 0,020 | 0,002 | 0,050 | 0,0089 | 0,08 | 0,04 | 16,0 | 7,0 | 71450 |
| 19 | 997300 | 169 | 550 | | | | | | | | | | 16,1 | 5,25 | |
| 20 | 880160 | 158 | 550 | 0,09 | 0,39 | 1,55 | 0,019 | 0,002 | 0,030 | 0,0089 | 0,08 | 0,04 | 16,0 | 5,30 | 71451 |
| 21 | 880160 | 194 | 520 | | | | | | | | | | 16,2 | 6,10 | |
| 22 | 880166 | 134 | 560 | 0,10 | 0,40 | 1,59 | 0,017 | 0,002 | 0,047 | 0,0089 | 0,08 | 0,04 | 16,0 | 5,0 | 71452 |
| 23 | 997329 | 149 | 550 | 0,09 | 0,38 | 1,67 | 0,018 | 0,002 | 0,047 | 0,0087 | 0,08 | 0,04 | 16,3 | 5,15 | 71514 |
| 24 | 997337 | 149 | 570 | 0,10 | 0,38 | 1,62 | 0,019 | 0,004 | 0,029 | 0,0086 | 0,08 | 0,04 | 15,9 | 4,75 | 71516 |
| 25 | 997321 | 175 | 550 | 0,09 | 0,33 | 1,57 | 0,015 | 0,004 | 0,037 | 0,0086 | 0,08 | 0,04 | 16,1 | 5,25 | 71548 |
| 26 | 997324 | 163 | 540 | | | | | | | | | | 15,9 | 5,60 | |
| 27 | 997309 | 204 | 530 | 0,09 | 0,37 | 1,55 | 0,014 | 0,003 | 0,043 | 0,0085 | 0,08 | 0,04 | 15,9 | 5,85 | 71549 |
| 28 | 880161 | 141 | 590 | 0,10 | 0,34 | 1,55 | 0,019 | 0,003 | 0,050 | 0,0050 | 0,08 | 0,04 | 16,0 | 4,35 | 71550 |
| 29 | 885026 | 210 | 500 | 0,09 | 0,34 | 1,60 | 0,018 | 0,003 | 0,044 | 0,0076 | 0,07 | 0,04 | 16,3 | 6,50 | 71690 |
| 30 | 885023 | 152 | 570 | 0,08 | 0,34 | 1,61 | 0,018 | 0,003 | 0,030 | 0,0089 | 0,08 | 0,04 | 16,1 | 4,70 | 71691 |
| 31 | 902052 | 127 | 600 | 0,10 | 0,37 | 1,65 | 0,020 | 0,003 | 0,032 | 0,0082 | 0,08 | 0,04 | 16,0 | 4,15 | 71697 |
| 32 | 902064 | 243 | 510 | 0,09 | 0,36 | 1,64 | 0,020 | 0,003 | 0,049 | 0,0090 | 0,07 | 0,05 | 16,2 | 6,30 | 71910 |
| 33 | 903214 | 188 | 550 | 0,09 | 0,38 | 1,64 | 0,020 | 0,004 | 0,037 | 0,0092 | 0,08 | 0,04 | 16,0 | 5,30 | 71911 |
| 34 | 903227 | 131 | 590 | 0,10 | 0,38 | 1,60 | 0,016 | 0,003 | 0,036 | 0,0109 | 0,07 | 0,04 | 15,9 | 4,35 | 71914 |
| 35 | 903202 | 176 | 540 | 0,10 | 0,38 | 1,58 | 0,018 | 0,003 | 0,031 | 0,0092 | 0,08 | 0,05 | 16,0 | 5,50 | 71915 |
| 36 | 903202 | 165 | 550 | | | | | | | | | | 16,2 | 5,20 | |
| 37 | 903203 | 247 | 490 | | | | | | | | | | 16,0 | 7,00 | |
| 38 | 903218 | 151 | 560 | 0,10 | 0,37 | 1,60 | 0,020 | 0,003 | 0,039 | 0,0064 | 0,07 | 0,04 | 16,3 | 4,90 | 71916 |
| 39 | 907018 | 222 | 540 | 0,10 | 0,35 | 1,60 | 0,108 | 0,003 | 0,050 | 0,0089 | 0,07 | 0,05 | 15,9 | 5,60 | 72147 |
| 40 | 903190 | 244 | 500 | 0,09 | 0,38 | 1,61 | 0,018 | 0,004 | 0,051 | 0,0077 | 0,07 | 0,04 | 15,9 | 6,70 | 72148 |
| 41 | 903190 | 232 | 510 | | | | | | | | | | 16,0 | 6,40 | |
| 42 | 996961 | 141 | 600 | 0,09 | 0,26 | 1,58 | 0,015 | 0,003 | 0,051 | 0,0107 | 0,07 | 0,03 | 14,8 | 4,75 | 10527 |
| 43 | 996961 | 144 | 590 | | | | | | | | | | 14,7 | 4,90 | |
| 44 | 996962 | 296 | 470 | | | | | | | | | | 14,8 | 7,80 | |
| 45 | 996964 | 282 | 500 | | | | | | | | | | 14,9 | 7,0 | |
| 46 | 996964 | 281 | 480 | | | | | | | | | | 14,7 | 7,60 | |
| 47 | 996966 | 266 | 510 | | | | | | | | | | 14,8 | 6,75 | |
| 48 | 996966 | 246 | 510 | | | | | | | | | | 14,7 | 6,80 | |
| 49 | 996963 | 247 | 530 | 0,10 | 0,24 | 1,49 | 0,014 | 0,004 | 0,039 | 0,0108 | 0,06 | 0,03 | 14,8 | 6,20 | 44359 |

TABLE 5

| Nr. | Hot Strip and/or Heavy Plate | Thickness in mm | CVN-$a_k$-Value in J/cm² −40° C. | CVN-$a_k$-Value in J/cm² at upper shelf | $\frac{Cv^{max.}}{Cv^{100}}$ | Test Position to the Axis pipe | Finishing Temperature in °C. | Coil or pile temp. in °C. | ΔT in °C. | Cooling rate in °C./s | REMARKS |
|---|---|---|---|---|---|---|---|---|---|---|---|
| 1 | 2 | 3 | 4 | 5 | 6 | 7 | 8 | 9 | 10 | 11 | 12 |
| 1 | 886/31CE/R | 15.2 | 80 | 183 | 2.29 | 60° zur RA | 820 | 670 | 150 | 3.35 | Customary hot strips or heavy plates, displaying a maximal number of separations with the Notch Impact Test. |
| 2 | | 15.2 | 104 | 231 | 2.22 | 90° zur RA | 820 | | 150 | 3.35 | |
| 3 | 93859 CA | 18.0 | 85 | 155 | 1.82 | 60° zur RA | 790 | | 140 | 2.5 | |
| 4 | | 18.0 | 94 | 214 | 2.28 | 90° zur RA | 790 | | 140 | 2.5 | |
| 5 | 817/26CE/R | 14.3 | 92 | 158 | 1.72 | 60° zur RA | 800 | 650 | 150 | 4.2 | |
| 6 | 9381 A/R | 17.6 | 106 | 153 | 1.44 | 60° zur RA | 780 | | 130 | 2.65 | |
| 7 | 886/31CM/R | 15.2 | 90 | 191 | 2.12 | 90° zur RA | 820 | | 175 | 3.75 | |
| 8 | | 15.2 | 103 | 231 | 2.24 | 60° zur RA | 820 | 645 | 175 | 3.75 | |
| 9 | | 15.2 | 70 | 113 | 1.61 | 90° zur RA | 820 | | 175 | 3.75 | |
| 10 | 817/30CE/R | 14.2 | 76 | 136 | 1.79 | 90° zur RA | 800 | 640 | 160 | 4.42 | |
| 11 | 886/31CA/R | 15.2 | 50 | 120 | 2.40 | 90° zur RA | 820 | | 185 | 3.90 | |
| 12 | | 15.2 | 80 | 151 | 1.89 | 60° zur RA | 820 | 635 | 185 | 3.90 | |
| 13 | 817/21CM/R | 14.9 | 110 | 162 | 1.47 | 60° zur RA | 810 | | 175 | 4.2 | |
| 14 | S | 18.5 | 118 | 214 | 1.81 | 60° zur RA | 750 | 630 | 120 | 2.4 | |
| 15 | 817/26CM/R | 14.5 | 82 | 135 | 1.65 | 90° zur RA | 810 | 625 | 185 | 4.5 | |

TABLE 5-continued

| Nr. | Hot Strip and/or Heavy Plate | Thickness in mm | CVN-$a_k$-Value in J/cm² −40° C. | CVN-$a_k$-Value in J/cm² at upper shelf | $\frac{C_V^{max.}}{C_V^{100}}$ | Test Position to the Axis pipe | Finishing Temperature in °C. | Coil or pile temp. in °C. | ΔT in °C. | Cooling rate in °C./s | REMARKS |
|---|---|---|---|---|---|---|---|---|---|---|---|
| 1 | 2 | 3 | 4 | 5 | 6 | 7 | 8 | 9 | 10 | 11 | 12 |
| 16 | 907023 | 16.0 | 130 | 235 | 1.81 | 90° zur RA | 770 | | 150 | 3.7 | |
| 17 | 817/30CA/R | 14.3 | 101 | 178 | 1.76 | 90° zur RA | 800 | 620 | 180 | 4.65 | |
| 18 | | 14.3 | 101 | 168 | 1.66 | 90° zur RA | 800 | | 180 | 4.65 | |
| 19 | 817/30CM/R | 14.4 | 103 | 160 | 1.55 | 60° zur RA | 800 | 615 | 185 | 4.75 | |
| 20 | 817/27CE/R | 14.3 | 103 | 149 | 1.45 | 90° zur RA | 800 | | 185 | 4.80 | |
| 21 | 907024 | 16.0 | 173 | 277 | 1.60 | 90° zur RA | 790 | | 180 | 4.00 | |
| 22 | | 16.0 | 171 | 272 | 1.59 | 90° zur RA | 790 | 610 | 180 | 4.00 | According to the invention, hot strips or heavy plates displaying a small number of separations with the Notch Impact Test than the customary hot strips |
| 23 | 817/27CM/R | 14.5 | 107 | 167 | 1.56 | 60° zur RA | 800 | | 190 | 4.85 | |
| 24 | 817/27CA/R | 14.5 | 130 | 187 | 1.44 | 60° zur RA | 800 | 605 | 195 | 4.90 | |
| 25 | | 14.5 | 82 | 114 | 1.39 | 90° zur RA | 800 | | 195 | 4.90 | |
| 26 | 995219/CM/R | 18.4 | 115 | 217 | 1.40 | 60° zur RA | 810 | 590 | 220 | 3.55 | |
| 27 | | 18.4 | 110 | 147 | 1.34 | 90° zur RA | 810 | | 220 | 3.55 | |
| 28 | 089/03 KA | 17.1 | 186 | 259 | 1.39 | 60° zur RA | 820 | | 240 | 4.10 | |
| 29 | 907023 | 16.0 | 179 | 303 | 1.69 | 90° zur RA | 770 | | 190 | 4.55 | |
| 30 | | 16.0 | 176 | 281 | 1.60 | 90° zur RA | 770 | 580 | 190 | 4.55 | |
| 31 | 907022 | 16.0 | 138 | 276 | 2.0 | 90° zur RA | 800 | | 220 | 4.55 | |
| 32 | 886/33 CA | 15.5 | 130 | 223 | 1.72 | 90° zur RA | 810 | | 240 | 4.90 | |
| 33 | | 15.5 | 157 | 223 | 1.42 | 90° zur RA | 810 | | 240 | 4.90 | |
| 34 | U | 18.3 | 123 | 246 | 2.0 | 60° zur RA | 780 | 570 | 210 | 4.20 | |
| 35 | 995214CM/R | 18.2 | 220 | 290 | 1.32 | 90° zur RA | 810 | | 240 | 3.85 | |
| 36 | 995214/CM/R | 18.2 | 185 | 254 | 1.37 | 90° zur RA | 810 | 570 | 240 | 3.85 | According to the invention, hot strips or heavy plates displaying a small number of separation with the Notch Impact test than the customary hot strips |
| 37 | 886/34 CER | 15.5 | 142 | 206 | 1.45 | 90° zur RA | 820 | | 250 | 4.80 | |
| 38 | 995213 CA | 18.2 | 222 | 300 | 1.35 | 60° zur RA | 830 | | 270 | 4.25 | |
| 39 | | 18.2 | 165 | 225 | 1.36 | 90° zur RA | 830 | 560 | 270 | 4.25 | |
| 40 | 817/21 CA/R | 15.0 | 170 | 228 | 1.34 | 60° zur RA | 800 | | 240 | 5.00 | |
| 41 | T | 18.3 | 131 | 256 | 1.95 | 60° zur RA | 850 | 550 | 300 | 6.00 | |
| 42 | 995214 CA | 18.1 | 197 | 201 | 1.02 | 90° zur RA | 820 | | 270 | 4.55 | Hot strips prepared according to the conditions of applicants' German priority application P 29 49 124.5 |
| 43 | | 18.1 | 320 | 322 | 1.00 | 60° zur RA | 820 | | 270 | 4.55 | |
| 44 | | 18.1 | 322 | 323 | 1.00 | 60° zur RA | 820 | | 270 | 4,55 | |
| 45 | 995215 CA | 18.3 | 199 | 215 | 1.08 | 90° zur RA | 790 | | 240 | 4.50 | |
| 46 | | 18.3 | 244 | 283 | 1.16 | 60° zur RA | 790 | 550 | 240 | 4.50 | |
| 47 | | 18.3 | 254 | 262 | 1.03 | 60° zur RA | 790 | | 240 | 4.50 | |
| 48 | 907023 | 16.0 | 215 | 277 | 1.29 | 90° zur RA | 770 | | 220 | 5.30 | |
| 49 | 817/22CM/R | 14.4 | 145 | 165 | 1.14 | 60° zur RA | 800 | | 250 | 6.10 | |
| 50 | 817/26CA/R | 14.4 | 180 | 190 | 1.06 | 60° zur RA | 800 | | 255 | 6.20 | |
| 51 | | 14.4 | 176 | 198 | 1.13 | 60° zur RA | 800 | | 255 | 6.20 | |
| 52 | 886/34CA/R | 15.3 | 285 | 317 | 1.12 | 60° zur RA | 815 | 545 | 270 | 5.65 | |
| 53 | D | 18.3 | 201 | 247 | 1.23 | 60° zur RA | 810 | | 265 | 5.40 | |
| 54 | 886/34CM/R | 15.4 | 264 | 288 | 1.09 | 60° zur RA | 825 | | 285 | 5.70 | Hot strips prepared according to the conditions of applicants' German priority application P 29 49 124.5 |
| 55 | | 15.4 | 187 | 240 | 1.28 | 90° zur RA | 825 | | 285 | 5.70 | |
| 56 | | 15.4 | 287 | 292 | 1.023 | 60° zur RA | 825 | 540 | 285 | 5.70 | |
| 57 | C | 18.3 | 246 | 308 | 1.25 | 90° zur RA | 800 | | 260 | 5.2 | |
| 58 | | 15.3 | 276 | 312 | 1.13 | 60° zur RA | 815 | | 280 | 5.90 | |
| 59 | 886/34CA/R | 15.3 | 287 | 326 | 1.14 | 60° zur RA | 815 | 535 | 280 | 5.90 | |
| 60 | | 15.3 | 207 | 253 | 1.22 | 90° zur RA | 815 | | 280 | 5.90 | |
| 61 | E | 18.3 | 222 | 272 | 1.23 | 90° zur RA | 800 | 530 | 270 | 5.4 | |
| 62 | 886/34CE/R | 15.5 | 292 | 305 | 1.04 | 60° zur RA | 820 | | 300 | 5.95 | |
| 63 | | 15.5 | 226 | 268 | 1.19 | 90° zur RA | 820 | | 300 | 5.95 | |
| 64 | 995225/CA/R | 18.9 | 250 | 250 | 1.0 | 90° zur RA | 780 | | 260 | 4.95 | |
| 65 | | 18.9 | 156 | 165 | 1.06 | 90° zur RA | 780 | 520 | 260 | 4.95 | |
| 66 | 995225/CM/R | 18.9 | 149 | 165 | 1.10 | 90° zur RA | 790 | | 270 | 4.95 | |
| 67 | 907022 | 16.0 | 186 | 241 | 1.30 | 90° zur RA | 800 | | 280 | 5.80 | |

TABLE 6

| Hot Strip or Plate | MELT | Chemical compositions of the Tested Steels in % — Chemical Composition: C | Si | Mn | P | S | Al | N | Nb | V | Mo | Cr | Ni | Sn | Cu |
|---|---|---|---|---|---|---|---|---|---|---|---|---|---|---|---|
| A | 11294 | .15 | .32 | 1.59 | .012 | .003 | .054 | .0098 | .02 | — | — | .03 | .75 | <.01 | .05 |
| B | 79486 | .08 | .35 | 1.76 | .015 | .010 | .048 | .0059 | .10 | — | .34 | .02 | .01 | <.01 | .03 |

TABLE 6-continued

| Hot Strip or Plate | MELT | Chemical compositions of the Tested Steels in % — Chemical Composition C | Si | Mn | P | S | Al | N | Nb | V | Mo | Cr | Ni | Sn | Cu |
|---|---|---|---|---|---|---|---|---|---|---|---|---|---|---|---|
| C | 79639 | .04 | .30 | 1.27 | .023 | .008 | .031 | .0055 | .09 | — | .35 | .02 | .02 | <.01 | .05 |
| D | 55161 | .06 | .23 | 1.47 | .022 | .007 | .040 | .0056 | .07 | — | .33 | .01 | .02 | <.01 | .03 |
| E | | | | | | | | | | | | | | | |
| F | 38070 | .10 | .34 | 1.59 | .016 | .012 | .041 | .0072 | .05 | .09 | — | .02 | .03 | <.01 | .04 |
| G | 38069 | .10 | .35 | 1.59 | .021 | .013 | .051 | .0057 | .04 | .08 | — | .03 | .03 | <.01 | .04 |
| H | 10381 | .09 | .33 | 1.58 | .015 | .011 | .059 | .0080 | .04 | .09 | — | .01 | .02 | <.01 | .03 |
| I | 43941 | .10 | .29 | 1.54 | .016 | .012 | .041 | .0057 | .08 | — | — | .02 | .03 | <.01 | .05 |
| J | 10527 | .09 | .26 | 1.58 | .015 | .003 | .051 | .0107 | .03 | .07 | — | .02 | .03 | <.01 | .03 |
| K | 44359 | .10 | .24 | 1.49 | .014 | .004 | .039 | .0108 | .03 | .06 | — | .02 | .03 | <.01 | .04 |
| L | 12078 | .07 | .26 | 1.67 | .019 | .004 | .048 | .0084 | .04 | .06 | — | .30 | .02 | <.01 | .03 |

TABLE 7

| Species of Steel | MELT | Manufacturing Conditions for "Separations-free" Steels — Outlet Thickness | Steel Plate Thickness | Pusher Furnace Temperature | Finishing Temperature | Coil or Pile temp. | Cooling Rate From WET to $T_H$ °C./S |
|---|---|---|---|---|---|---|---|
| A | 11294 | 200 | 20 | 1230 | 750 | 540 | 2,5° |
| B | 79486 | 210 | 18,3 | 1180 | 790 | 540 | 5 |
| C | 79639 | 205 | 18,3 | 1180 | 800 | 540 | 5,2 |
| D | 55161 | 210 | 18,3 | 1180 | 810 | 545 | 5,4 |
| E | | 203 | 18,3 | 1180 | 800 | 530 | 5,4 |
| F | 38070 | 201 | 13,5 | 1220 | 790 | 480 | 8,7 |
| G | 38069 | 200 | 13,5 | 1220 | 800 | 500 | 8,5 |
| H | 10381 | 200 | 14,8 | 1180 | 770 | 490 | 7,2 |
| I | 43941 | 205 | 14,8 | 1180 | 770 | 485 | 7,5 |
| J | 10527 | 205 | 14,8 | 1180 | 760 | 460 | 8,0 |
| K | 44359 | 200 | 14,8 | 1180 | 770 | 500 | 7,2 |
| L | 12078 | 200 | 16,0 | 1180 | 780 | 550 | 5,1 |

TABLE 8

| Hot Strip or Plate | Test Position | The mechanical-technological characteristics of "separations-free" steels — Characteristic: Yield Stress $R_{p0,2}$ Mpa | Tensile Strength $R_m$ Mpa | $A_5$ % | $a_k$-Value in J/cm² $Cv^{100}$ | $Cv^{max}$ | $TU_{50\%}$ | Transition Temperature in °C. $Cv^{100}$ | $TU_{50\%}$ | $Cv^{max.}/Cv^{100}$ |
|---|---|---|---|---|---|---|---|---|---|---|
| A | L | 441 | 490 | 28,1 | 210 | 258 | 140 | −35 | −50 | 1.23 |
| | Q | 471 | 587 | 29,4 | 229 | 259 | 165 | −80 | −45 | 1.13 |
| B | L | 561 | 756 | 20,4 | 102 | 110 | 73 | −35 | −48 | 1.08 |
| | Q | 610 | 765 | 18,2 | 40 | 48 | 26 | −30 | −51 | 1.20 |
| C | L | 499 | 621 | 22,0 | 246 | 308 | 94 | −76 | −104 | 1.25 |
| | Q | 539 | 641 | 19,1 | 64 | 66 | 58 | −30 | −49 | 1.03 |
| D | L | 503 | 629 | 22,7 | 201 | 247 | 67 | −72 | −108 | 1.23 |
| | Q | 518 | 651 | 18,3 | 80 | 95 | 62 | −36 | −58 | 1.19 |
| E | L | 521 | 634 | 22,5 | 222 | 272 | 125 | −65 | −74 | 1.23 |
| | Q | 571 | 660 | 19,8 | 74 | 79 | 55 | −30 | −52 | 1.06 |
| F | L | 546 | 651 | 24,3 | 175 | 187 | 60 | −30 | −67 | 1.07 |
| | Q | 589 | 672 | 12,3 | 49 | 56 | 34 | −30 | −60 | 1.14 |
| G | L | 556 | 660 | 24,2 | 119 | 139 | 62 | −60 | −77 | 1.17 |
| | Q | 599 | 689 | 21,6 | 45 | 50 | 34 | −30 | −65 | 1.11 |
| H | L | 506 | 629 | 26,7 | 160 | 201 | 65 | −60 | −93 | 1.26 |
| | Q | 551 | 639 | 23,7 | 58 | 63 | 30 | −40 | −82 | 1.09 |
| I | L | 505 | 625 | 25,6 | 155 | 189 | 86 | −60 | −92 | 1.22 |
| | Q | 535 | 635 | 22,1 | 53 | 59 | 45 | −40 | −57 | 1.11 |
| J | L | 535 | 632 | 26,8 | 246 | 277 | 129 | −80 | −90 | 1.13 |
| | Q | 560 | 648 | 22,8 | 154 | 186 | 80 | −60 | −82 | 1.21 |
| K | L | 522 | 622 | 27,1 | 183 | 227 | 83 | −80 | −100 | 1.24 |
| | Q | 565 | 637 | 23,1 | 152 | 169 | 65 | −60 | −95 | 1.11 |
| L | L | 555 | 657 | 25,7 | 233 | 303 | 125 | −90 | −110 | 1.30 |
| | Q | 616 | 692 | 21,3 | 140 | 170 | 70 | −69 | −100 | 1.21 |

We claim:

1. In a method for the manufacture of hot strips or heavy plates from a denitrated steel composed of 0.04 to 0.16% carbon, 1.25 to 1.90% manganese, 0.2 to 0.55% silicon, 0.004 to 0.020% phosphorus, 0.002 to 0.015% sulfur, 0.02 to 0.08% aluminum, 0.02 to 0.08% niobium, the remainder iron and possibly contaminants, the improvement comprising the steps of having the hot strips or plates leaving the last finishing stand of rolls at a temperature of 750° C. to 820° C., cooling the hot strips or plates to an intermediate temperature of 450° C. to 500° C. at a cooling rate of 2° to 10° C./s and then slowly cooling the hot strips or plates in air to room temperature in a coil or in a pile.

2. Method according to claim 1, wherein the steel is alloyed with 0.02 to 0.10% addition of vanadium.

3. In a method for the manufacture of hot strips or heavy plates from a denitrated steel composed of 0.04 to 0.16% carbon, 1.25 to 1.90% manganese, 0.02 to 0.55% silicon, 0.004 to 0.020% phosphorus, 0.002 to 0.015% sulfur, 0.02 to 0.08% aluminum, 0.02 to 0.08% niobium, as well as addition of 0.15 to 0.35% molybdenum, 0.10 to 0.30% chromium and/or 0.30 to 0.90% nickel, alone or in combination, the remainder iron and possibly contaminants, the improvement comprising the steps of having the hot strips or plates leaving the last finishing stand of rolls at a temperature of 750° C. to 850° C., cooling the hot strips or plates to an intermediate temperature of 450° C. to 500° C. at a cooling rate of 2° to 10° C./s and then slowly cooling the hot strips or plates in air to room temperature in a coil or in a pile.

4. Method according to claim 3, wherein the steel is alloyed with 0.02 to 0.10% addition of vanadium.

5. Method according to claim 3 or 4, wherein the finishing temperature lies between 750° C. and 820° C.

6. Method according to claim 3, wherein the steel includes an addition of 0.002 to 0.08% zirconium.

7. Method according to claim 3, wherein the steel includes an addition of 0.004 to 0.051% cerium.

8. Hot strips or heavy plates manufactured according to the method of claim 1 or 3.

9. Hot strips or heavy plates according to claim 8, wherein the steel exhibits a ferritic-perlitic structure.

10. Hot strips or heavy plates according to claim 8, wherein the ratio of Cvmax to Cv100 lies between 1.0 and 1.3.

11. Hot strips or heavy plates according to claim 8, wherein the ratio of Cvmax to Cv100 lies between 1.3 and 2.0.

12. Hot strips or heavy plates according to claim 8, having a maximum impact tenacity value of 280 J/cm$^2$ at a test temperature of −20° C.

13. Hot strips or heavy plates according to claim 8, having a maximum impact tenacity value of 230 J/cm$^2$ at a test temperature of −40° C.

* * * * *